US008747022B1

(12) United States Patent
Case

(10) Patent No.: US 8,747,022 B1
(45) Date of Patent: Jun. 10, 2014

(54) SCREED TOW POINT ASSEMBLY FOR A PAVER

(71) Applicant: Caterpillar Paving Products Inc., Brooklyn Park, MN (US)

(72) Inventor: Aaron Case, Saint Michael, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 13/747,124

(22) Filed: Jan. 22, 2013

(51) Int. Cl.
*E01C 19/22* (2006.01)
*E01C 19/42* (2006.01)
*E04F 21/24* (2006.01)

(52) U.S. Cl.
CPC ..... *E01C 19/42* (2013.01); *E01C 2301/00* (2013.01); *E04F 21/24* (2013.01)
USPC ..... 404/118

(58) Field of Classification Search
CPC ..... E01C 19/42; E01C 2301/00; E04F 21/24
USPC ..... 404/83, 96, 101, 105, 108, 114, 118
See application file for complete search history.

(56) References Cited

U.S. PATENT DOCUMENTS

| | | | | |
|---|---|---|---|---|
| 3,316,821 | A | 5/1964 | Davin | |
| 3,997,277 | A | 12/1976 | Swisher, Jr. et al. | |
| 4,678,364 | A | 7/1987 | Charonnat et al. | |
| 5,201,603 | A | 4/1993 | Bassett et al. | |
| 5,401,115 | A * | 3/1995 | Musil et al. | 404/72 |
| 5,556,227 | A | 9/1996 | Ulrich | |
| 2009/0047069 | A1 | 2/2009 | Herrmann | |

FOREIGN PATENT DOCUMENTS

| | | | |
|---|---|---|---|
| DE | 10025462 | A1 | 12/2001 |
| DE | 102010029705 | A1 | 4/2011 |
| EP | 1179636 | A1 | 2/2002 |
| GB | 1054151 | A | 1/1967 |

* cited by examiner

*Primary Examiner* — Raymond W Addie
(74) *Attorney, Agent, or Firm* — Leydig, Voit & Mayer

(57) ABSTRACT

Tow point assembly includes a tow arm, tow point plate, and tow point support for securing to a traction unit. A rearward end of the tow arm is adapted for securing to a screed assembly, and a forward end pivotably coupled to the tow point plate at a pivot point. The tow point plate is slidably disposed through an opening in the tow point support with the rollers of two coupled roller assemblies disposed to roll on the forward edges of the tow point support, and rollers of a third roller assembly disposed to roll on contact with rearward edges.

20 Claims, 5 Drawing Sheets

SCREED TOW POINT ASSEMBLY FOR A PAVER

TECHNICAL FIELD

The present invention relates generally to pavers of the floating screed type, and more particularly to the tow point assembly used to join the floating screed and traction unit portions of such a paver.

BACKGROUND

"Floating screed" asphalt finishing machines, or pavers, have provided an efficient and economical method of coating an old or new roadway with a compacted layer of asphalt aggregate for many years. Floating screed pavers are generally known to those skilled in the art, as reflected by the disclosure contained in U.K. Patent 1,054,151 to the Blaw-Knox Company. Such a paver typically comprises a self-propelled traction unit, or tractor, having a hopper at its front end for receiving paving material, such as asphalt aggregate, from a dump truck.

A conveyor system on the machine transfers the paving material from the hopper rearwardly for distribution in front of a floating screed. Transversely arranged screw augers positioned at the rear end of the traction unit assist in moving the paving material in a lateral direction with respect to the direction of movement of the paver, so that a relatively uniform volume of paving material is distributed across the portion of the roadbed in front of the floating screed.

The screed is commonly operated so as to "float" by virtue of being connected to the forwardly moving machine by means of pivoted leveling arms or tow arms. With forward movement, the screed physically levels any paving material lying higher than a predetermined height above the roadway surface, leaving a generally uniform thickness of such material. This function is enhanced by inclining the bottom surface of the screed so that its forward edge is higher than its rear edge, thereby providing a smaller area between the screed and the roadway and a large dragging surface at the rear of the screed. The angle defined between the bottom surface of the screed and the roadway surface is called the "angle of attack." The screed also compacts the dragged paving material in order to provide a uniform, smooth, durable pavement surface. The screed is often mounted to vibrate against the pavement material to assist in spreading and compacting the material.

The leveling arms of the screed are attached to the paver fraction unit at a "tow point." In early pavers this point was a simple fixed pin connection. As a result, the thickness of the resulting paved mat could only be controlled by means of altering the screed angle of attack. Later paver designs allowed the tow point to be moved vertically, causing a corresponding movement in the leveling arms and screed. This arrangement accommodated changes in the grade of the road surface by automatically fine tuning the initial setting of the screed angle of attack, thereby controlling the pavement mat thickness.

The tow point connection between the traction unit and screed units affects two aspects of paver operation, in particular. It is generally preferred to add asphalt to the paver while the paver is still moving in order to avoid joints or dips and valleys in the resulting asphalt mat caused by stopping and starting movement of the machine. Thus, dump trucks containing the asphalt material are usually positioned ahead of, and in the path of, the paver. As the paver approaches the truck, or as the truck is backed towards the paver, push rollers on the front of the paver engage or are engaged by the dump truck's rearmost tires. At the moment of impact between the truck and paver, the paver is usually urged backwards, particularly if the truck has been backed into it. A screed can damage the surface of the newly laid asphalt mat, causing bumps and valleys, if the screed leveling arm is rigidly connected to the traction unit as a paver is urged backwards.

Further, the distance between the screed and the transverse auger of the traction unit is usually adjusted to reflect the largest aggregate particle size being laid. In many asphalt mixes, especially those with high percentages of recycled asphalt, it is desirable to minimize the gap between the transverse auger and the front plate of the screed to minimize the buildup of hardened "dead" material, thereby reducing tearing of the asphalt mat and improving the quality of the end product. This gap is adjusted most easily at the tow point.

SUMMARY

The disclosure describes, in one aspect, a tow point assembly for pivotably coupling a screed assembly rearward a traction unit in a paver for distributing paving material onto a roadway surface. The tow point assembly includes a tow arm, a tow point plate, and a tow point support. The tow arm has a forward end and a rearward end, the rearward end adapted to be secured to the screed assembly. The tow point plate is pivotably coupled to the forward end of the tow arm at a pivot axis. The tow point support is adapted to be secured to the traction unit. The tow point support includes a pair of substantially parallel forward edges and a pair of substantially parallel rearward edges. The forward edges and the rearward edges define an elongated opening between the forward and rearward edges and extending through the tow point support. The tow point plate is slidably disposed through the opening for substantially vertical movement. Three roller assemblies are coupled to the tow point plate. Each said roller assembly includes first and second rotatably mounted rollers disposed on opposite sides of the tow point plate. A first and a second of said roller assemblies are disposed such that the first and second rollers of the first and second roller assemblies roll upon contact with the forward edges. The third of said roller assemblies is disposed such that the first and second rollers of the third of said roller assemblies roll on contact with respective rearward edges.

The disclosure describes, in another aspect, a method of coupling a screed assembly to a traction unit in a paver for distributing paving material onto a roadway surface. The method includes securing a pair of tow point supports in a substantially vertical configuration to respective opposite sides of the traction unit, each tow point support including a pair of substantially parallel forward edges and a pair of substantially parallel rearward edges, the forward edges and the rearward edges defining an elongated opening extending through the tow point support between the forward and rearward edges, coupling rearward ends of a pair of tow arms to the screed assembly and disposing the tow arms along the opposite sides of the traction unit, pivotably coupling a pair of tow point plates to respective forward ends of the pair of tow arms, each tow point plate including three roller assemblies, each roller assembly including first and second rotatably mounted rollers disposed on opposite sides of the respective tow point plate, slidably disposing forward ends of the tow point plates for substantially vertical movement through the respective openings in the tow point supports with a first and a second of said roller assemblies disposed such that the first and second rollers of the first and second roller assemblies roll upon contact with the forward edges of the respective tow point support, and the third of said roller assemblies being disposed such that the first and second rollers of the third of said roller assemblies rolls on contact with rearward edges of the respective tow point support.

BRIEF DESCRIPTION OF THE DRAWING(S)

DETAILED DESCRIPTION

Figure 1:
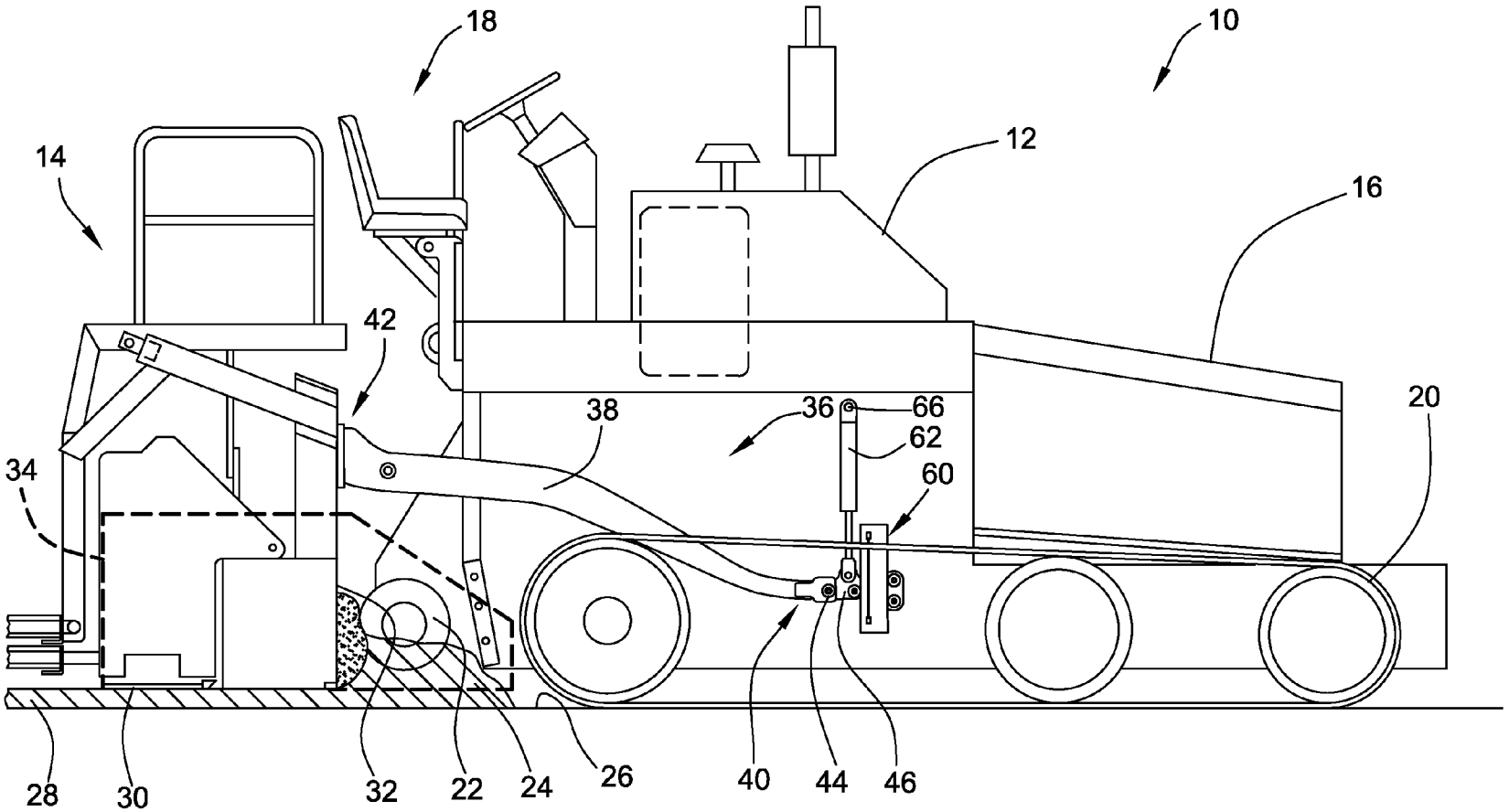
FIG. 1 is a side elevational view of a paver constructed in accordance with aspects of the present disclosure.

This disclosure relates to an arrangement for connection of tow arms to a traction unit to couple a screed plate assembly to traction unit in a paver. The arrangement may be more readily understood by reference to the accompanying drawings. FIG. 1 shows a side elevational view a paver 10, having a fraction unit 12, such as tractor, with a screed assembly 14 disposed at the rearward portion of the paver 10 and a hopper 16 at the forward portion of the paver 10. Traction unit 12 provides the motive force for the paver 10, and typically includes an engine (not shown), operator station 18, and ground engaging movers, such as the tracks 20 illustrated or tires (not illustrated).

In operation, paving material, such as an asphalt mix, is transferred into the hopper 16 at the forward portion of the paver 10. The paver 10 includes a conveyor system (not visible), typically including one or more longitudinally disposed conveyors that are used to transport the asphalt to the rearward portion of the paver 10. Transverse screw augers 22 are typically positioned at the rearward portion of the paver 10 and spread the asphalt material 24 out laterally on roadway surface 26 in front of the screed assembly 14.

The screed assembly 14 may be of any appropriate design known in the art or later developed. For example, the screed assembly 14 may include an arrangement for vibrating one or more elements of the screed assembly 14 to enhance distribution, leveling and compaction of the asphalt material 24 into a finished asphalt mat 28. The exemplary embodiment of the screed assembly 14 illustrated in FIG. 1 includes a sole plate 30, front plate 32, and end gate 34 (shown in phantom in the interests of clarity), which are used to contain and level the deposited asphalt material 24 on the roadway. A thickness control (not illustrated) that may be used by the operator to adjust the angle of inclination (i.e., "angle of attack") of screed sole plate 30 in order to adjust the thickness of the resulting asphalt mat 28. The thickness control may be of any appropriate arrangement and may include, for example, a rod and bearing arrangement.

The illustrated screed assembly 14 is a floating type arrangement, that is, the screed assembly 14 is pivotably connected to the traction unit 12 by means of a tow point assembly 36 disposed along opposite sides of the traction unit 12. It should be understood that the tow point assembly 36 and its elements will be discussed in the singular, that is, with regard to one side of the traction unit 12. It is to be understood that like elements coexist on the other side of the traction unit 12 in mirror image.

The tow point assembly 36 includes a tow arm 38 that has a forward end 40 and a rearward end 42. The rearward end 42 is coupled to the screed assembly 14, while the forward end 40 is coupled to the traction unit 12 at a tow point connection 44. The forward end 40 of the tow arm 38 is pivotably connected to a tow point plate 46 at a pivot axis 48. While the tow arm 38 may be a unitary structure in an alternate embodiment, the illustrated tow arm 38 includes a mounting bracket 50 secured to a tow arm element 39. The illustrated mounting bracket 50 includes arms 52 that are disposed on opposite sides of the tow point plate 46, and the mounting bracket 50 is pivotably coupled to the tow point plate 46 by a bearing assembly 54 (see FIG. 5). The bearing assembly 54 may be of any appropriate design. In the illustrated embodiment, a self-aligning bearing 56 is disposed along a pin 58, which may provide a low friction connection between the tow arm 38 and the tow point plate 46 that may be readily maintained and serviced. A self-aligning bearing 56 allows some angular displacement between the tow arm 38 and the tow point plate 46 in planes other than the generally vertical plane including the tow arm 38 and the tow point plate 46. That is, the pivot axis 48 itself may pivot about a pivot point 59 during operation as the self-aligning bearing 56 permit minor sideways angular movement between the tow arm 38 and the tow point plate 46.

The tow point plate 46 is coupled to the side of the fraction unit 12 at both a tow point support 60 and a hydraulic cylinder 62, both of which are coupled to the traction unit 12. One end of the hydraulic cylinder 62 is coupled to the tow point plate 46 at connection point 64. The opposite end of the hydraulic cylinder 62 is coupled to the traction unit 12 at connection point 66. In the illustrated embodiment, the connection point 64 of the hydraulic cylinder 62 is disposed in afore-aft direction of the paver 10 between the pivot point 59 at the tow point connection 44 and the tow point support 60.

Further, the tow point plate 46 is slideably coupled to the side of the traction unit 12 by way of the tow point support 60. In the illustrated embodiment the tow point support 60 includes a pair of plates 68, 70, the plates 68, 70 being in a parallel configuration as show in FIG. 5. The plates 68, 70 are held in spaced relation by a number of spacers 80. Each of the plates 68, 70 presents a forward edge 72, 74 and a rearward edge 76, 78. An elongated opening 82 is defined between the plates 68, 70 between for the forward and rearward edges 72, 74, 76, 78.

The tow point plate 46 extends through the opening 82 between the parallel plates 68, 70. Grade sensors (not shown) connected to the paver 10 may send electrical signals to a hydraulic valve (not shown) on the traction unit 12 to cause hydraulic cylinder 62 to retract or extend, and in so doing raise or lower the tow point plate 46 relative to the tow point support 60, and, with the tow point plate 46, tow arm 38 and the screed assembly 14. In this way, the distance between screed sole plate 30 and roadway surface 26 may be automatically fine tuned to reflect changes in the grade of the roadway. A linear scale 84 may be provided on the tow point support 60 or the like in order to provide a readily assessable visual indication of the general placement of the tow point plate 46 along the tow point support 60.

Figure 2:
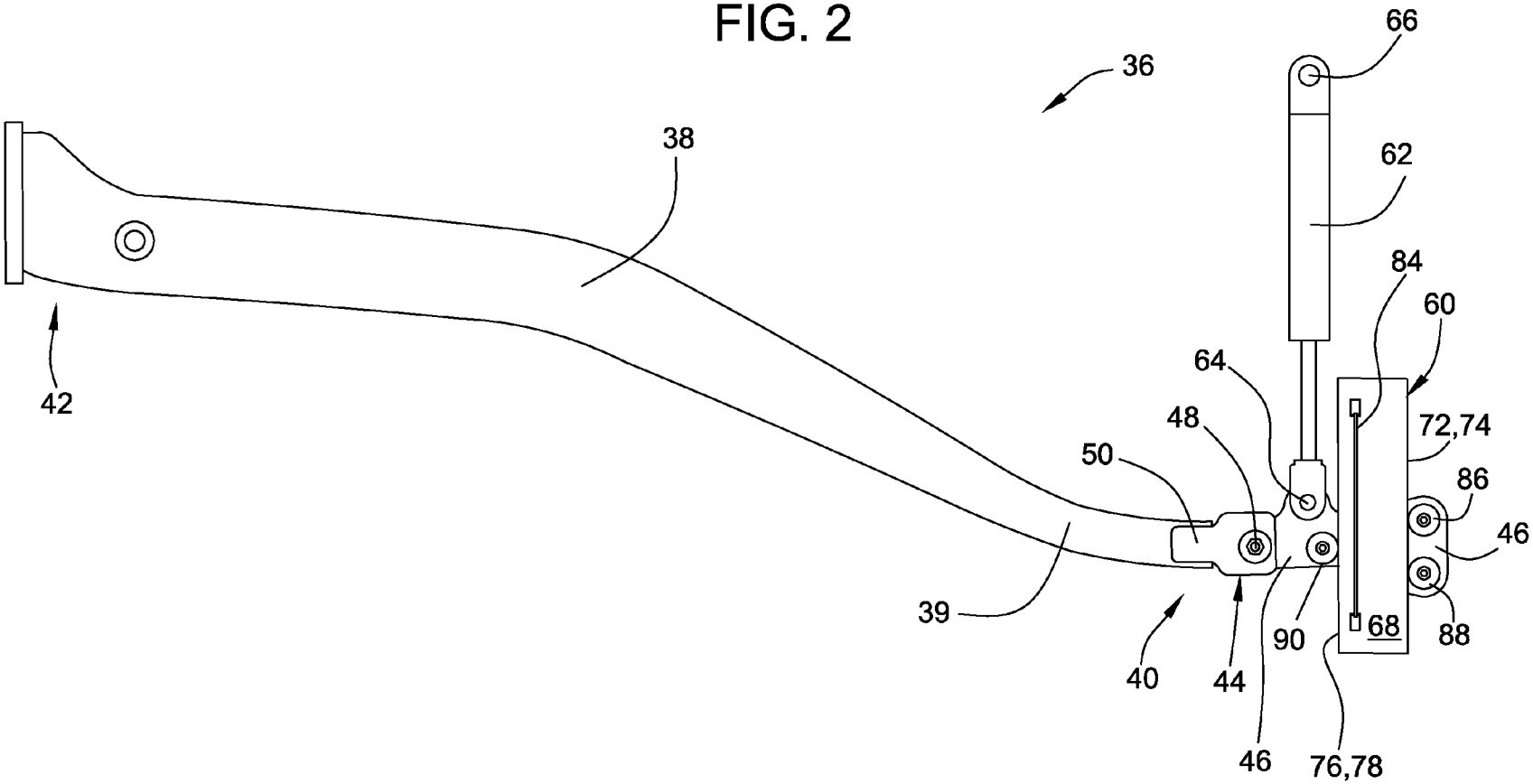
FIG. 2 is a side elevational view of a tow point assembly of the right side of the paver of FIG. 1.
Figure 3:
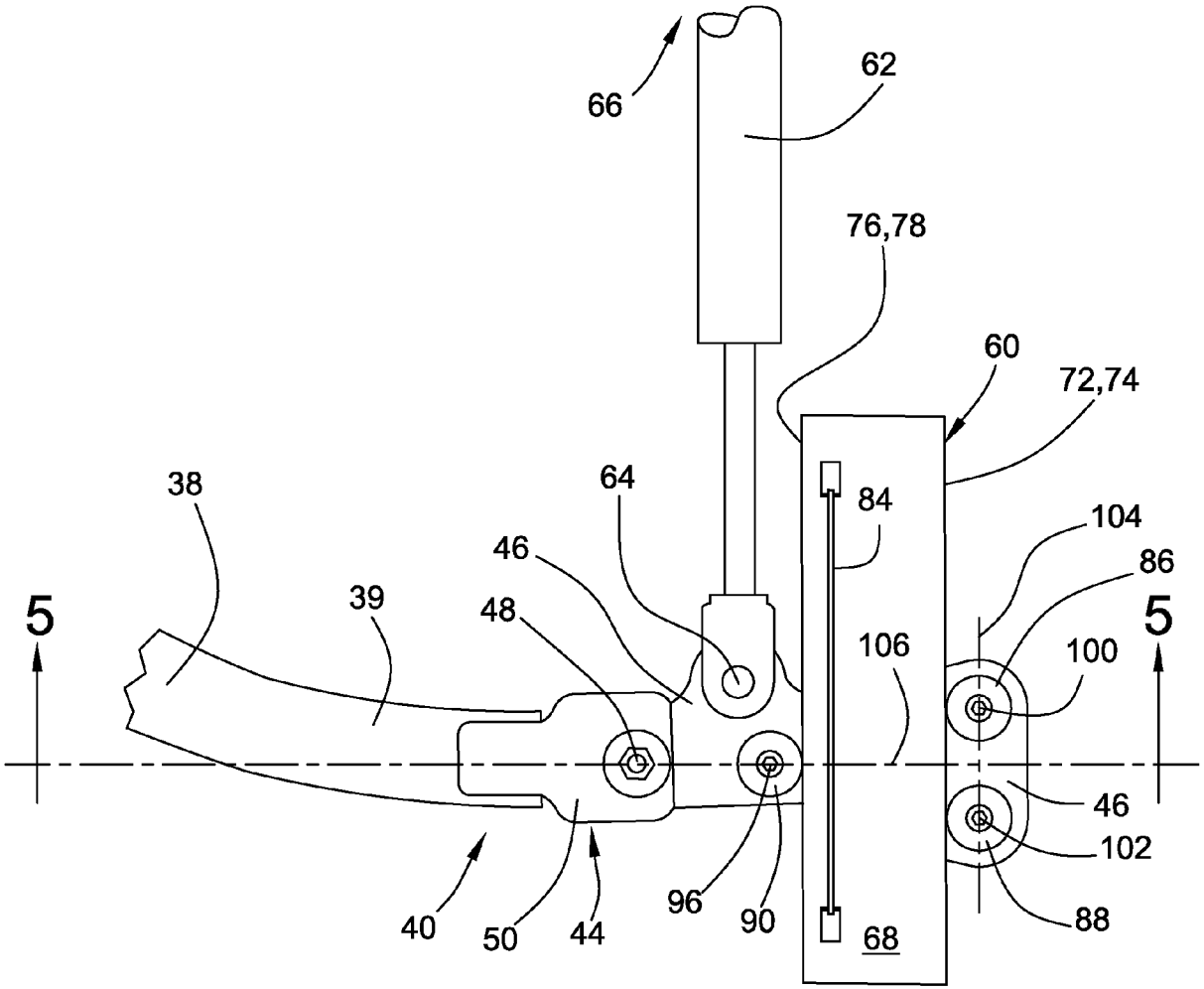
FIG. 3 is an enlarged fragmentary view of the tow point assembly of FIGS. 1-2.
Figure 4:
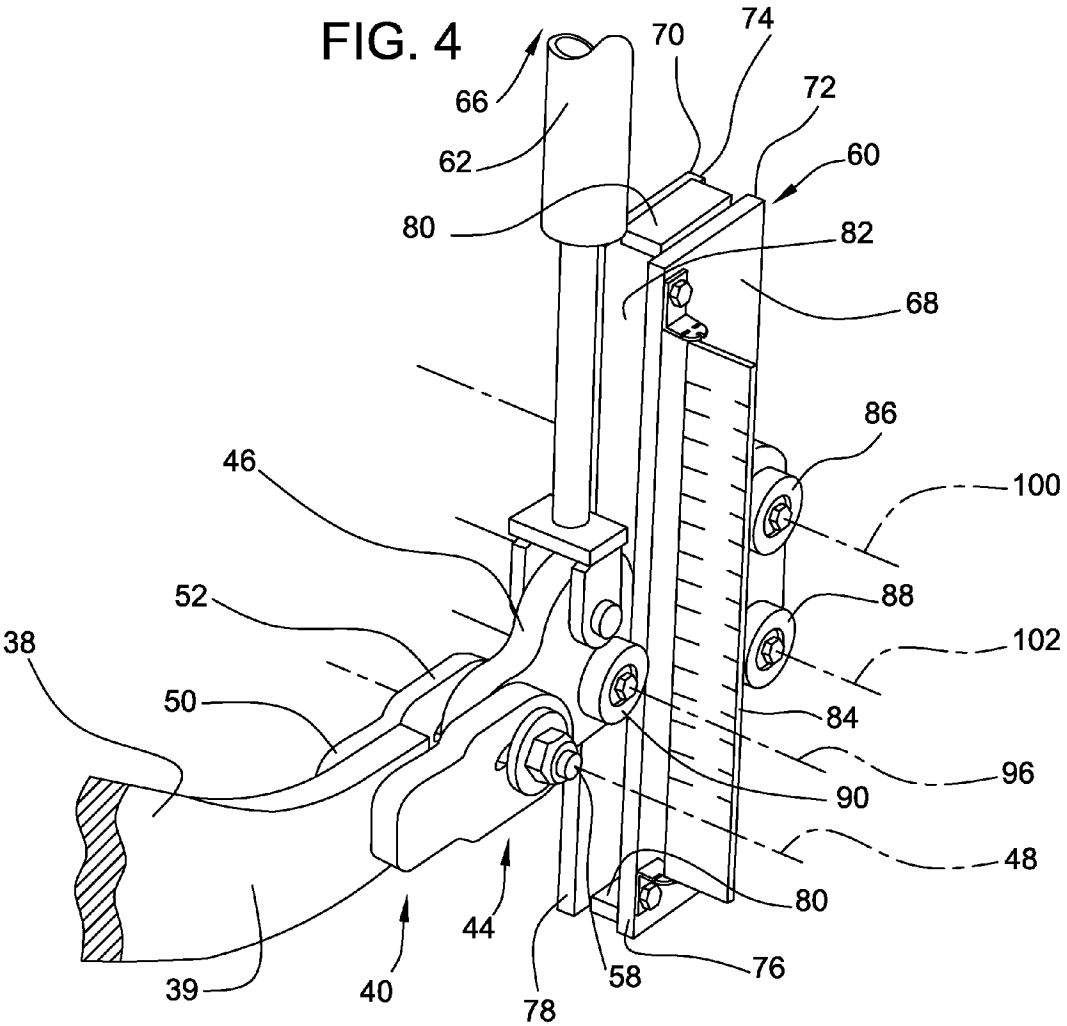
FIG. 4 shows a fragmentary isometric view of the tow point assembly of FIGS. 1-3.

As shown in FIGS. 2 and 3, the tow point plate 46 is mounted to slide up and down within the opening 82 by three roller assemblies 86, 88, 90 rotatably coupled to the tow point plate 46. First and second roller assemblies 86, 88 are disposed to roll along the forward edge of the tow point support 60, and a third roller assembly 90 is disposed along the rearward edge of the tow point support 60. In this way, the rearwardly directed force applied from tow arm 38 is distributed between the first and second roller assemblies 86, 88 along the forward edge of the tow point plate 46. The single roller assembly 90 disposed along the opposite side of the tow point support 60 assists in leveling the tow point plate 46 while minimizing racking of the tow point plate 46 along the tow point support 60.

Figure 5:
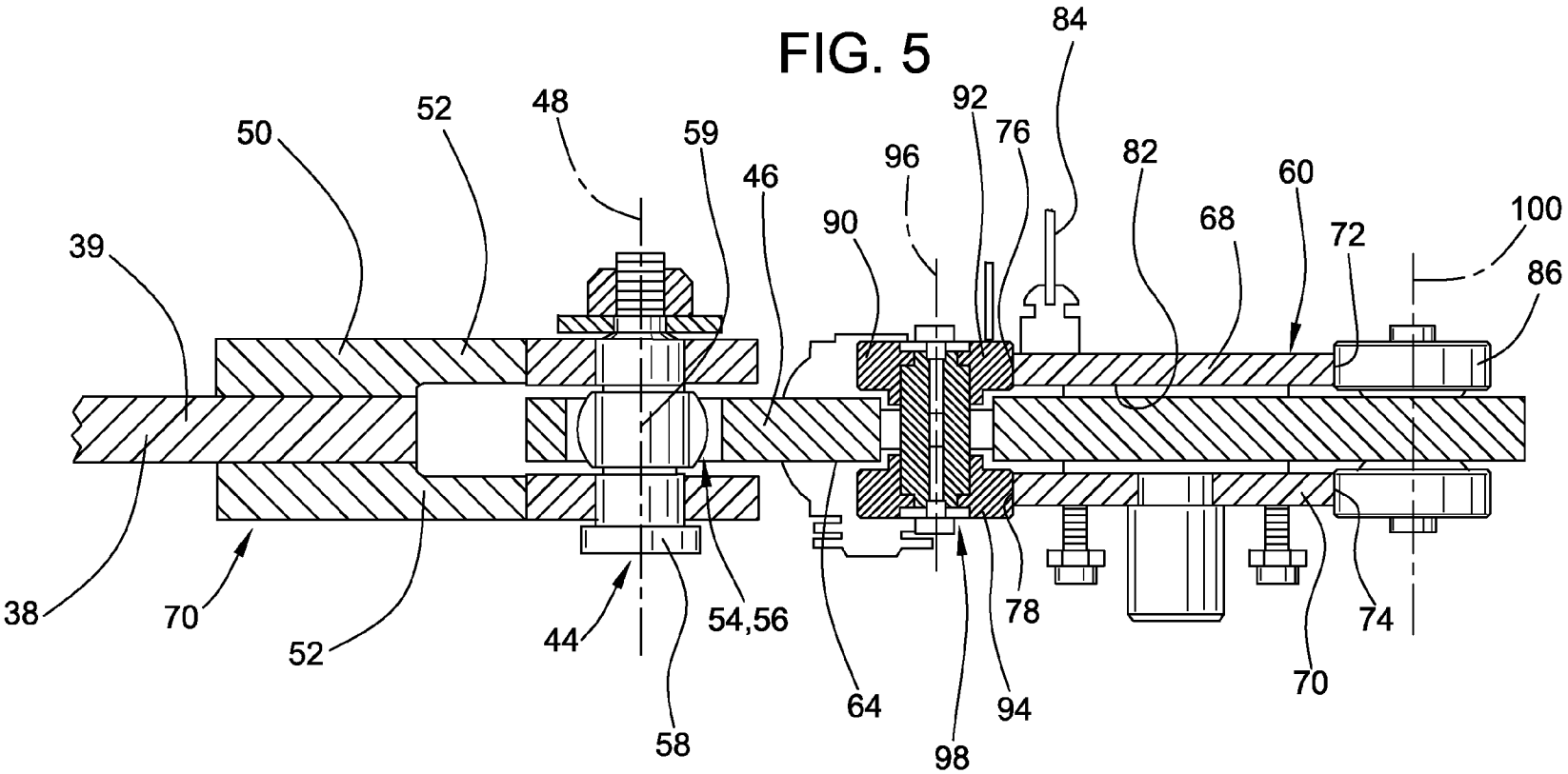
FIG. 5 is a cross-sectional view taken along line 5-5 in FIG. 3.

The structure of the roller assemblies 86, 88, 90 may be seen more clearly in FIG. 5, which shows a cross section taken along line 5-5 in each of FIG. 3. While the structure of the roller assemblies 86, 88, 90 is explained with regard to roller assembly 90, each of the roller assemblies 86, 88, 90 includes a similar structure. Roller assembly 90 includes a pair of rollers 92, 94 that are disposed on either side of the tow point plate 46 along an axis 96 such that they ride on the rearward edges 76, 78 of the respective plates 68, 70 of the tow point support 60. The rollers 92, 94 may be coupled by any appropriate arrangement. In the illustrated embodiment, they are coupled by a self-aligning bearings 98, although an alternate arrangement may be utilized.

As may best be seen in FIGS. 3 and 5, the roller assemblies 86, 88, 90 of the illustrated embodiment include rollers 92, 94 that are of like diameter. In an alternate embodiment, however, the first and second roller assemblies 86, 88 include rollers of like diameter, while the third roller assembly 90 includes rollers 92, 94 that are of an alternate diameter. As a result, it will be noted that the axes 100, 102 of the first and second roller assemblies 86, 88 are disposed along a first plane 104 that is substantially parallel to the forward edges 72, 74 of the tow point support 60. The third roller assembly 90 is disposed between on the rearward edges 76, 78 of the tow point support 60 between the first and second roller assemblies 86, 88. That is, the axis 100 of the third roller assembly 90 is disposed along a second plane 106 that extends substantially perpendicular to the first plane 104 between the axes 100, 102 of the first and second roller assemblies 86, 88. It is noted that the second plane 106 extends substantially perpendicularly to the tow point support 60. In the illustrated embodiment, the second plane 106 is disposed substantially midway between the axes 100, 102 of the first and second roller assemblies 86, 88.

In the illustrated embodiment, the pivot point 59 is likewise disposed in a plane that is substantially perpendicular to the tow point support 60 or to the first plane 104 between the axes 100, 102 of the first and second roller assemblies 86, 88, i.e., the pivot point 59 is disposed in the second plane 106.

INDUSTRIAL APPLICABILITY

The present disclosure is applicable to pavers 10. Embodiments of the disclosure may provide a free floating screed assembly 14. Embodiments may minimize external forces on the screed assembly 14, and may provide enhanced mat quality.

In some embodiments, the alignment of the pivot point 59 in the second plane 106 may provide for a relatively even distribution of forces between first and second roller assemblies 86, 88, particularly when the second plane 106 is disposed substantially midway between the axes 100, 102 of the first and second roller assemblies 86, 88.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A tow point assembly for pivotally coupling a screed assembly rearward a traction unit in a paver for distributing paving material onto a roadway surface, the tow point assembly comprising:

a tow arm having a forward end and a rearward end, the rearward end adapted to be secured to the screed assembly, a tow point plate, the tow point plate being pivotably coupled to the forward end of the tow arm at a pivot point, a tow point support adapted to be secured to the traction unit, the tow point support including a pair of substantially parallel forward edges and a pair of substantially parallel rearward edges, the forward edges and the rearward edges defining an elongated opening between the forward and rearward edges and extending through the tow point support, the tow point plate being slidably disposed through the opening for substantially vertical movement, and three roller assemblies coupled to the tow point plate, each of said roller assemblies including first and second rotatably mounted rollers disposed on opposite sides of the tow point plate, a first and a second of said roller assemblies being disposed such that the first and second rollers of the first and second roller assemblies roll upon contact with the forward edges, and a third of said roller assemblies being disposed such that the first and second rollers of the third of said roller assemblies roll on contact with respective rearward edges.

2. The tow point assembly of claim 1 further including a self-aligning bearing disposed between the tow point plate and the tow arm.

3. The tow point assembly of claim 1 further including self-aligning bearings between at least one of the roller assemblies and the tow point plate.

4. The tow point assembly of claim 1 wherein each of the roller assemblies includes a respective axis, the axes of the first and second roller assemblies being disposed in a first plane, the axis of the third roller assembly being disposed in a second plane, the second plane being disposed substantially perpendicular to the first plane, and extending from the first plane between the axes of the first and second roller assemblies.

5. The tow point assembly of claim 4 wherein the pivot point is disposed in the second plane.

6. The tow point assembly of claim 4 further including self-aligning bearings between at least one of the roller assemblies and the tow point support.

7. The tow point assembly of claim 1 wherein the pivot point and an axis of the third roller assembly are disposed in a plane that extends substantially perpendicularly to the tow point support.

8. The tow point assembly of claim 1 wherein the tow arm includes a mounting bracket, the mounting bracket including a pair of spaced arms disposed along opposite sides of the tow point plate and being pivotally coupled to the tow point plate.

9. The tow point assembly of claim 1 wherein the tow point plate further including a connection point disposed forward the pivot point and rearward the tow point support.

10. The tow point assembly of claim 9 further including a hydraulic cylinder coupled to the connection point at one end and adapted to be coupled to the traction unit at an opposite end.

11. The tow point assembly of claim 6 further including self-aligning bearings disposed between the roller assemblies and the tow point plate, and wherein the tow arm includes a mounting bracket, the mounting bracket including a pair of spaced arms disposed along opposite sides of the tow point plate and being pivotably coupled to the tow point plate.

12. A paver for distributing paving material onto a roadway surface, the paver comprising:

a traction unit, a screed assembly, a tow arm having a forward end and a rearward end, the rearward end secured to the screed assembly, a tow point support secured to the traction unit in a substantially vertical configuration, the tow point support including a pair of substantially parallel forward edges and a pair of substantially parallel rearward edges, the forward edges and the rearward edges defining an elongated opening extending through the tow point support between the forward and rearward edges, a tow point plate, the tow point plate being pivotably coupled to the forward end of the tow arm at a pivot point, the tow point plate being slidably disposed through the opening for substantially vertical movement, and three roller assemblies coupled to the tow point plate, each of said roller assemblies including first and second rotatably mounted rollers disposed on opposite sides of the tow point plate, the tow point plate and a first and a second of said roller assemblies being disposed such that the first and second rollers of the first and second roller assemblies roll upon contact with the forward edges, and a third of said roller assemblies being disposed such that the first and second rollers of the third of said roller assemblies roll on contact with respective rearward edges.

13. The paver of claim 12 further including a self-aligning bearing disposed between at least one of the tow point plate and the tow arm, or between at least one of the roller assemblies and the tow point plate.

14. The paver of claim 12 wherein each of the roller assemblies includes a respective axis, the axes of the first and second roller assemblies being disposed in a first plane, the axis of the third roller assembly being dispose in a second plane, the second plane being disposed substantially perpendicular to the first plane, and extending from the first plane between the axes of the first and second roller assemblies.

15. The paver of claim 14 wherein the pivot point is disposed in the second plane.

16. The paver of claim 13 wherein the pivot point and an axis of the third roller assembly are disposed in a plane that extends substantially perpendicularly to the tow point support.

17. The paver of claim 13, wherein the tow arm includes a mounting bracket, the mounting bracket including a pair of spaced arms disposed along opposite sides of the tow point plate and being pivotably coupled to the tow point plate.

18. The paver of claim 13 wherein the tow point plate further including a connection point disposed forward the pivot point an rearward the tow point support and a hydraulic cylinder coupled to the connection point at one and coupled to the traction unit at an opposite end.

19. A method of coupling a screed assembly to a traction unit in a paver for distributing paving material onto a roadway surface, the method comprising:

securing a pair of tow point supports in a substantially vertical configuration to respective opposite sides of the traction unit, each tow point support including a pair of substantially parallel forward edges and a pair of substantially parallel rearward edges, the forward edges and the rearward edges defining an elongated opening extending through the tow point support between the forward and rearward edges, coupling rearward ends of a pair of tow arms to the screed assembly and disposing the tow arms the opposite sides of the traction unit, pivotably coupling a pair of tow point plates to respective forward ends of the pair of tow arms, each tow point plate including three roller assemblies, each roller assembly including first and second rotatably mounted rollers disposed on opposite sides of the respective tow point plate, slidably disposing the tow point plates for substantially vertical movement through the respective openings in the tow point supports with a first and a second of said roller assemblies disposed such that the first and second rollers of the first and second roller assemblies roll upon contact with the forward edges of the respective tow point support, and a third of said roller assemblies being disposed such that the first and second rollers of the third of said roller assemblies roll on contact with rearward edges of the respective tow point support.

20. The method of claim 19 further including coupling first ends of respective hydraulic cylinders to respective connection points on the tow point plates, each connection point being disposed forward the tow arm and rearward the tow point support, and coupling the opposite ends of the hydraulic cylinders to the traction unit.

* * * * *

UNITED STATES PATENT AND TRADEMARK OFFICE

CERTIFICATE OF CORRECTION

PATENT NO. : 8,747,022 B1
APPLICATION NO. : 13/747124
DATED : June 10, 2014
INVENTOR(S) : Aaron Case It is certified that error appears in the above-identified patent and that said Letters Patent is hereby corrected as shown below:

In the Specification

Column 1, line 49, delete “fraction” and insert -- traction --.

Column 3, line 27, delete “fraction” and insert -- traction --.

Column 4, line 26, delete “fraction” and insert -- traction --.

In the Claims

Column 6, line 33, in Claim 1, delete “pivotally” and insert -- pivotably --.

Column 7, line 21, in Claim 8, delete “pivotally” and insert -- pivotably --.

Column 8, line 8, in Claim 14, delete “dispose” and insert -- disposed --.

Column 8, line 18, in Claim 17, delete “claim 13,” and insert -- claim 13 --.

Column 8, line 24, in Claim 18, delete “an” and insert -- and --.

Column 8, line 39, in Claim 19, delete “tow arms the” and insert -- tow arms along the --.

Signed and Sealed this
Fifteenth Day of September, 2015

Michelle K. Lee

Michelle K. Lee
*Director of the United States Patent and Trademark Office*